United States Patent [19]

Rayburn

[11] 4,433,285

[45] Feb. 21, 1984

[54] INTEGRATED TUBE SOCKET ASSEMBLY

[75] Inventor: Joseph W. Rayburn, Bowie, Md.

[73] Assignee: Arinc Research Corp., Annapolis, Md.

[21] Appl. No.: 377,801

[22] Filed: May 13, 1982

[51] Int. Cl.[3] ..... H01J 19/62

[52] U.S. Cl. ..... 323/364; 339/190; 361/423

[58] Field of Search ..... 323/364; 361/423, 303; 313/250; 339/190; 332/63

[56] References Cited

U.S. PATENT DOCUMENTS

| | | | |
|---|---|---|---|
| 2,427,563 | 9/1947 | Lavoie | 361/423 |
| 2,458,390 | 1/1949 | Larkin et al. | 339/190 |
| 2,960,754 | 11/1960 | Coda et al. | 361/423 |
| 2,977,494 | 3/1961 | Johnstone et al. | 339/190 |
| 3,042,893 | 7/1962 | Chin et al. | 339/190 |

*Primary Examiner*—William H. Beha, Jr.
*Attorney, Agent, or Firm*—Parkhurst & Oliff

[57] ABSTRACT

An electron tube socket assembly capable of withstanding shocks up to 18 G's, operating in the frequency range of 10 KH to 1000 megahertz and conducting filament currents on the order of 250 amperes. Stacked contactors are positioned so as to encircle corresponding ring contacts on an electron tube. Film-type capacitors are positioned between the contactors so as to be physically integrated into the construction of the tube assembly. Lump capacitors associated with the delivery of the modulated RF signal to the filament element of the tube are physically positioned between the filament contactors such that the delivery of the modulated RF signal through the capacitors and each of the filament contactors is substantially equidistant and a balancing effect is achieved. The contactors contain apertures dimensioned to allow cooling air to pass through to cool the anode of the tube being used in the socket assembly yet prevent the feedback of RF energy from the tube output to the tube input.

6 Claims, 9 Drawing Figures

INTEGRATED TUBE SOCKET ASSEMBLY

BACKGROUND OF THE INVENTION

The present invention relates to tube sockets and more particularly to tube sockets adapted to be used with tubes having balanced filament feeding and which are so constructed as to be able to accommodate high power requirements (including filament currents on the order of 250 amperes), high frequencies (up to 150 megacycles), and withstand high shock or gravatational requirements (on the order of 18 G's).

In electron tube applications, such as amplifiers, oscillators and the like, involving very high frequencies, designers of prior art tube socket assemblies, such as that disclosed in U.S. Pat. No. 2,427,563 to Lavoie, have recognized the advantages of utilizing an integrated structure by "sandwiching" bypass capacitors and connectors. Such a construction affords paths of low impedance for tube element connections to ground without necessitating externally placed capacitors and the resultant wiring problems. In addition, the patent to Lavoie stresses the need for keeping the length and inductance of the leads to the tube elements and between stages to a minimum to avoid objectionable regeneration and parasitic oscillations by stray electrostatic or magnetic coupling and by the effect of a common impedance between stages when a single power supply is used. This is accomplished in Lavoie by providing an integrated tube socket comprising a plurality of metallic stacking plates arranged in spatial relation to contact corresponding terminals on a tube, separated by suitable dielectric elements so as to constitute bypass capacitors which may be connected to ground and to the appropriate external circuit components to provide the aforementioned low impedance paths to ground.

Another example of a known tube socket assembly having integrated bypass capacitors positioned between the tube contactors is shown in FIG. 1. The socket assembly 100 shown in FIG. 1 comprises a base plate 102, a screen contact ring 104, a grid contact ring 106, and a ground ring 108. Positioned between the base plate 102 and contact rings 104, 106, 108 are bypass capacitors 110, 112, and 114. Located beneath the tube, which is shown by phantom lines, is a filament contact 116 supported by a plastic filament support 118 which in turn is supported by a cathode contact ring 120. The cathode contact ring 120 has a cylindrical extension 122 which provides electrical contact with the tube. Electrically connected to the anode of the tube is the anode contact ring 124. A plurality of threaded rod and nut constructions secure the assembly together to provide an integrated tube socket assembly.

Another concern of tube socket designers is that in operation of tubes at high frequencies using direct heating (i.e. introducing the signal at the filament) it is desirable to feed the modulated signal across the filament using a "balancing" technique. Balancing introduces the signal into each of the two leads of the filament in synchronous fashion. To introduce the signal across the two leads, capacitors are utilized. Although integration of the components into the assembly is desirable, it is impracticable to utilize wafer thin, "sandwiched" bypass capacitors, such as shown in FIG. 1, due to the nature of the assembly; i.e. the capacitors are not connected to a ground plate or connector. Accordingly, balancing has been achieved using external capacitors to feed the signal into the tube socket for entry at the filament. However, the wiring or leads connecting the externally located capacitors have caused problems due to the introduction of stray inductance and capacitance. At high frequencies the size of the leads and lead length is critical in avoiding resonance problems developed by the inductive and capacitive components associated with stray capacity attributable to the closeness of leads to ground and to each other.

Accordingly, it is an object of this invention to provide an integrated tube socket structure which minimizes lead lengths associated with balancing capacitors used in a filament feed for a high power, high frequency tube.

Another important consideration in the design of a tube socket is the provision of passages for allowing cooling air through the interior of the socket assembly to the tube. U.S. Pat. No. 2,977,494 to Johnstone, et al., discloses the use of annular slots or ducts formed in a base plate to provide for the passage of cooling air within the tube socket directed so as to strike the tube. Similarly in tube sockets of the prior art, elaborate measures have been utilized to provide a cooling effect. U.S. Pat. No. 3,042,893 to Chin, et al., discloses channels formed in the vicinity of the tube base. However, one potential disadvantage when utilizing tube socket constructions having the above mentioned provisions for cooling the tube is that the RF developed during high frequency usage may be transmitted through such cooling openings into the socket assembly so as to interfere with the functioning of the terminals exposed by the openings.

Accordingly, it is an object of the present invention to provide a tube socket assembly which incorporates annular cooling holes for cooling the anode which are so configured as to prevent RF from entering the tube socket assembly.

Another object of the present invention is to provide a tube socket assembly which incorporates an assembly of low inductance annular plates wherein the capacitance required by the various connectors is physically integrated into the tube socket structure.

A further object of the present invention is to provide a tube socket having a balanced filament feed provided by integrally contained capacitors so as to minimize stray inductance and capacitance when the tube is operating at its operating frequencies. Furthermore, because the length of the path of travel of currents through the tube socket assembly is significant at high frequencies, another object is to equalize the paths of travel of the signal as it is introduced into each of the two leads of the tube filament.

Still another object of the present invention is to provide a tube socket having contact rings which are fabricated with sufficient strength to support the tube when subjected to shocks exceeding 18 G's and having sufficient mass to transfer tube element heating from the metal/ceramic seals of the tube, and to maintain the seal temperature below manufacturer's specified temperature (approximately 250° C.) when operated under worst case conditions.

Additional objects and advantages of the invention will become apparent to those skilled in the art upon further review of the following description of the invention.

SUMMARY OF THE INVENTION

The present invention achieves the above objects and provides a tube socket assembly for electron tubes capable of operating at high frequencies with high power output requirements. The tube socket assembly is considered universal in nature as it is designed for use in low or high input impedance circuits (grounded grid, or grounded cathode operation) with only a slight modification of the tube socket configuration. The design of the tube socket assembly provides excellent isolation between the input and output circuits.

The tube socket assembly of the present invention is a generally annular construction arranged around a vertical center line and comprises a plurality of contactor rings with central openings. The annular contactor rings are fabricated from aluminum and/or brass alloys having a thickness of approximately ¼ inch, so as to present minimal inductance at both high and low frequencies and to support the tube when subjected to shocks of up to 18 G's. Also, due to the dimensional thickness of the contactor rings, the mass is such as to allow adequate convection to provide a cooling effect. Both upper and lower contactor rings are stacked vertically and are appropriately spaced to provide the corresponding contact with the tube element contact. A removable bolt construction securely positions the upper contactor rings, i.e. a screen grid contactor, a grid spacer, a control grid contactor, and a grid/ground contactor, whereby the spacing of the contactor rings may be changed by removing the bolts and utilizing a different positioning arrangement. In the lower portion of the tube socket assembly spaced filament contactors are arranged for contact with the corresponding tube filament contacts. To facilitate airflow through the socket to cool the tube anode, iris cutouts or cooling holes circumferentially located adjacent the central openings in the upper contactor rings provide through vertical channels for the passage of air which are so configured as to screen out RF signals which might interfere with the linear operation of the tube. The holes are dimensioned so as to prevent passage of RF operating frequencies therethrough. Annular thin film double clad mylar bypass capacitors are physically integrated into the design of the upper portion tube socket assembly by being sandwiched between the cover and the screen grid contactor, the screen grid contactor and the grid spacer, the grid spacer and the control grid contactor, and the control grid contactor and the grid/ground contactor, and are substantially coextensive therewith so as to eliminate the need for external bypass capacitors. Through the integration of the thick contact rings and the thin film bypass capacitors, the electrical components that affect frequency are equally distributed and, therefore, improved frequency stability is achieved. Separate discrete lump balancing capacitors are used in conjunction with the filament contactors which transmit the modulated signal so as to create an equal path of conductance to each of the contacts of the tube filament from which the modulated signal is emitted. The balancing capacitors are integrated into the physical structure of the tube socket assembly and are positioned so as to be fixed or sandwiched between the filament contactor elements so that the distance travelled by the modulated signal through both contact leads is substantially the same to facilitate balancing. Furthermore, the contactor rings of the present invention are of sufficient thickness (e.g. one quarter of an inch) to reduce inductive problems. The screen grid and control grid contacts on the tube are embraced by the corresponding contactor rings through resilient finger contacts extending around the entire inner periphery of the contactor ring to reduce contact resistance, capacitance and inductance.

BRIEF DESCRIPTION OF THE DRAWINGS

The attendant advantages of the present invention will be readily apparent from the following detailed description thereof which is presented in conjunction with the accompanying drawings, wherein.

DESCRIPTION OF THE PREFERRED EMBODIMENTS

Figure 1:
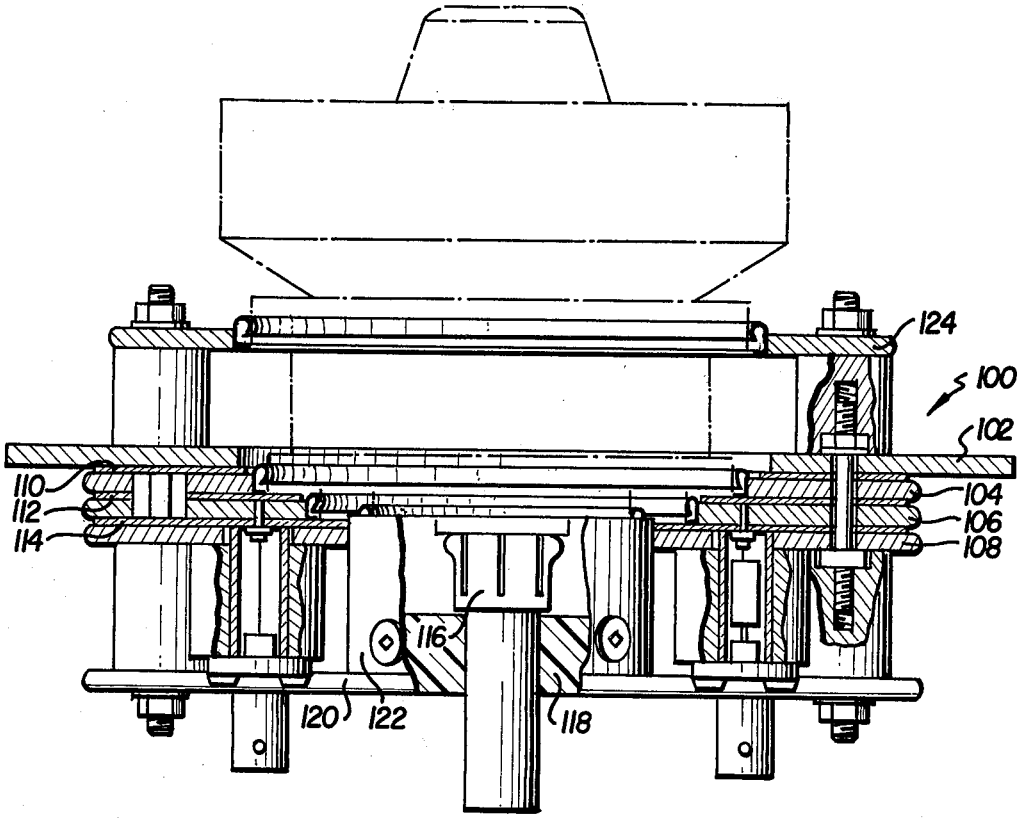
FIG. 1 is a partial cross sectional view of a prior art tube socket assembly.
Figure 2:
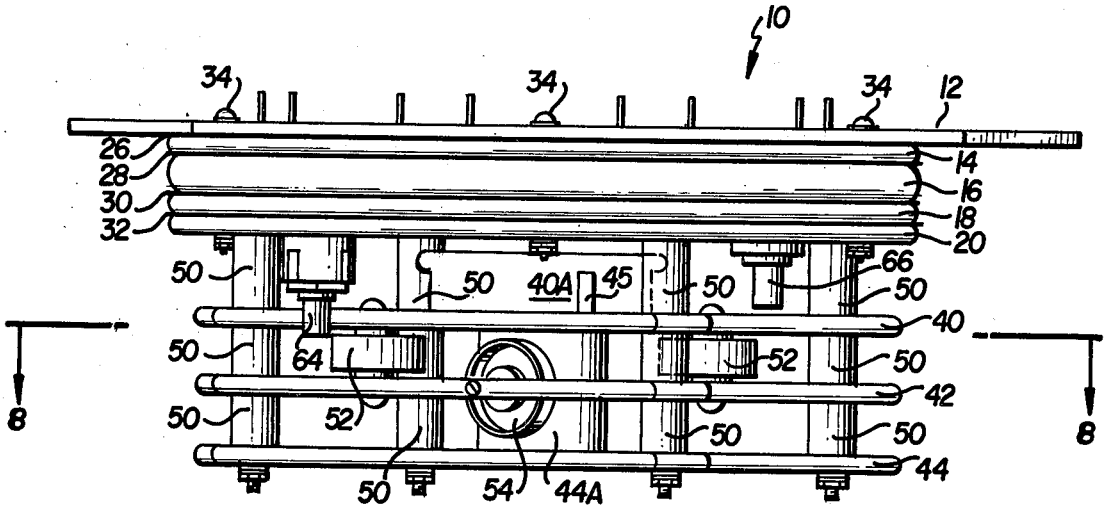
FIG. 2 is a side view of the preferred embodiment of the present invention.

Referring now to the drawings, wherein like reference characters designate like or corresponding parts throughout the several views, FIG. 2, a side view, shows a tube socket assembly 10 having a cover 12 adapted to be mounted in a housing (not shown). Arranged underneath cover 12 in layer-like fashion are a plurality of annular elements fabricated from aluminum, aluminum alloys or brass alloys. More specifically, arranged in descending order as seen in FIG. 2, are a screen grid contactor 14, a grid spacer 16, a control grid contactor 18, and a grid/ground contactor 20. These annular elements have outside diameters of approximately 10 inches and inside diameters ranging from approximately 4 to 4.2 inches. In the preferred embodiment, the contactors 14, 18, 20 are approximately ¼ inch thick to minimize inductance at high frequencies and the grid spacer 16 is approximately ½ inch thick. It can be readily appreciated by those skilled in the art that due to the annular configuration and dimensonal thickness and width of contactors 14, 18, 20 inductance problems normally associated with the dimensional thickness and width are minimized. It should be noted, however, that the specific dimensions given above are merely exemplary and various dimensional changes could be made to accommodate various types of tubes within the purview of the invention.

Figure 4:
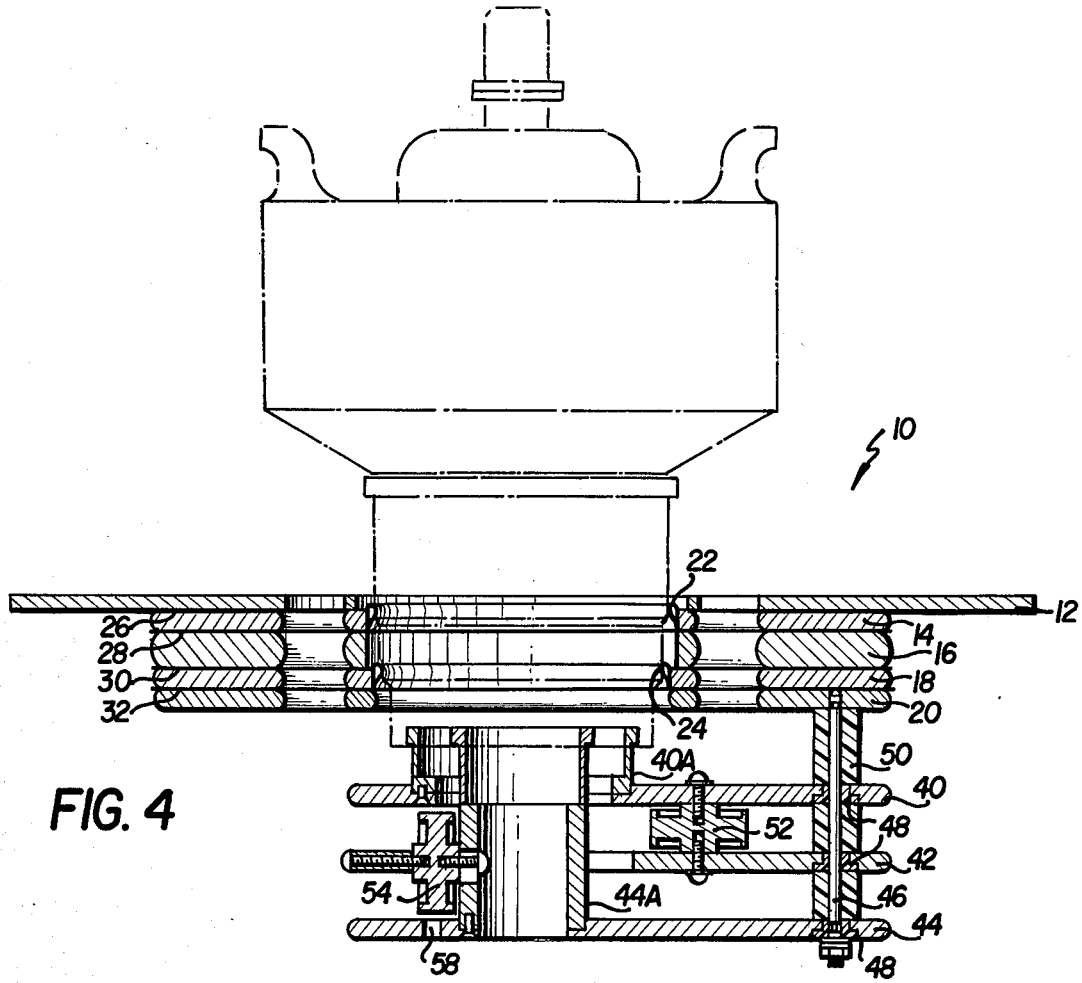
FIG. 4 is a cross sectional view showing a tube in phantom lines taken along a line 4—4 in FIG. 3.

As best seen in FIG. 4, a cross sectional view, the control grid contactor 18 and the screen grid contactor 14 are electrically connected with the corresponding tube contacts by means of contact rings 22, 24 which comprise closely spaced resilient, finger-like projections. Substantially the entire circumference (360°) of each respective tube contact is engaged by the finger-like projections of the contact rings 22, 24 so as to eliminate "hot spots", and resistance, capacitance and inductance are minimized. Furthermore, the finger-like projections provide a uniform feed to the tube contact rings. Due to the placement of screen grid contactor 14 (i.e. below cover 12), when cover 12 is grounded the screen grid is effectively isolated from RF emitted from the tube.

Integrated into the physical structure of assembly 10 are four, annular thin film bypass capacitors 26, 28, 30, 32 which provide low impedance paths to ground at high frequencies. The bypass capacitors may be fabricated utilizing a centrally positioned mylar dielectric which is sandwiched between two thin sheets of copper. The capacitance developed by the capacitors when installed between the contactor elements is determined by the following equation (neglecting fringe effects at the edges of the capacitor plates):

$$C=0.225\ e_r[(N-1)A/T]\ \text{picofarads}$$

where:

A=Area of one side of one plate in square inches

N=Number of plates

T=Thickness of dielectric in inches $e_r$=Dielectric constant (for Mylar the dielectric constant is 2.89)

Thin film bypass capacitor 26 is positioned between cover 12 and screen grid contactor 14. The bypass capacitor 28 is sandwiched between the screen grid contactor 14 and the grid spacer 16, which is grounded. Sandwiched between grid spacer 16 and control grid contactor 18 is bypass capacitor 30, while bypass capacitor 32 is sandwiched between grid/ground contactor 20 and control grid contactor 18.

Figure 5:
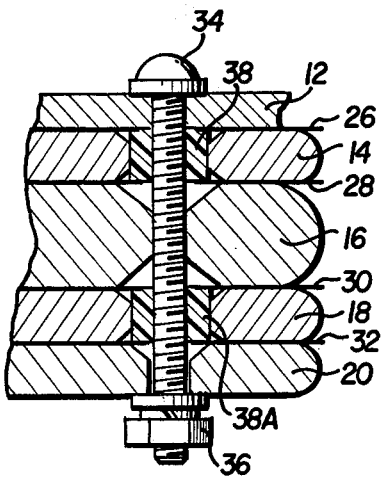
FIG. 5 is a partial cross sectional view taken along line 5—5 in FIG. 3 showing the bolted construction which holds the contactors in place.

The cover 12, contactors 14, 18, 20, grid spacer 16 and bypass capacitors 26, 28, 30, 32 are rigidly secured together by four bolts 34 and nuts 36 in removable fashion, as shown in FIG. 5. Consequently if a tube is to be inserted into the socket assembly having a different contact spacing, tube assembly 10 may be disassembled and contactor elements of different dimensions or spacer elements could be utilized to achieve a mating effect. As seen in FIG. 5, insulating cylinders 38, 38A prevent the screen grid contactor 14 and control grid contactor 18, respectively, from being grounded by bolts 34.

Figure 3:
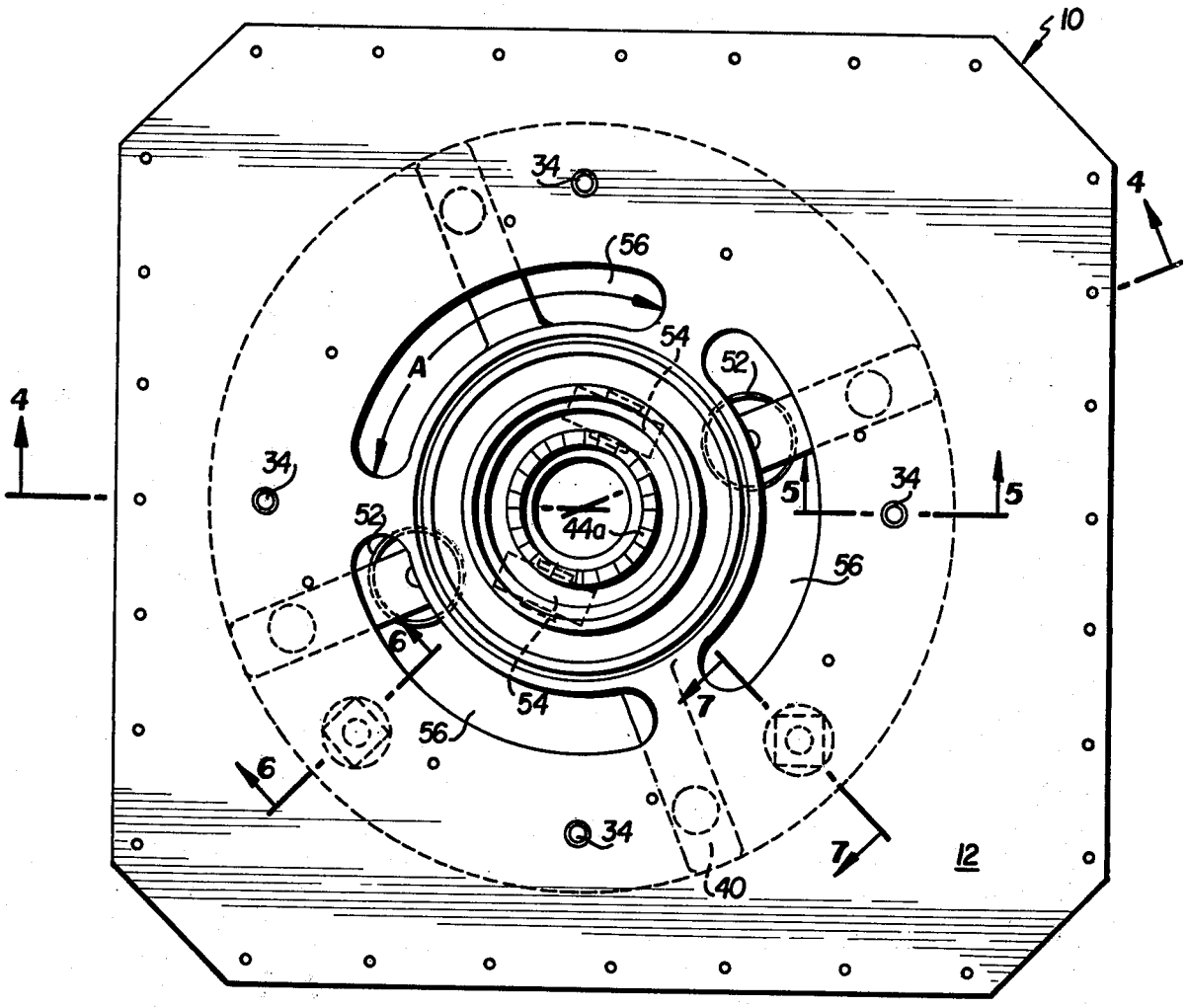
FIG. 3 is a plan view of the FIG. 2 embodiment.
Figure 8:
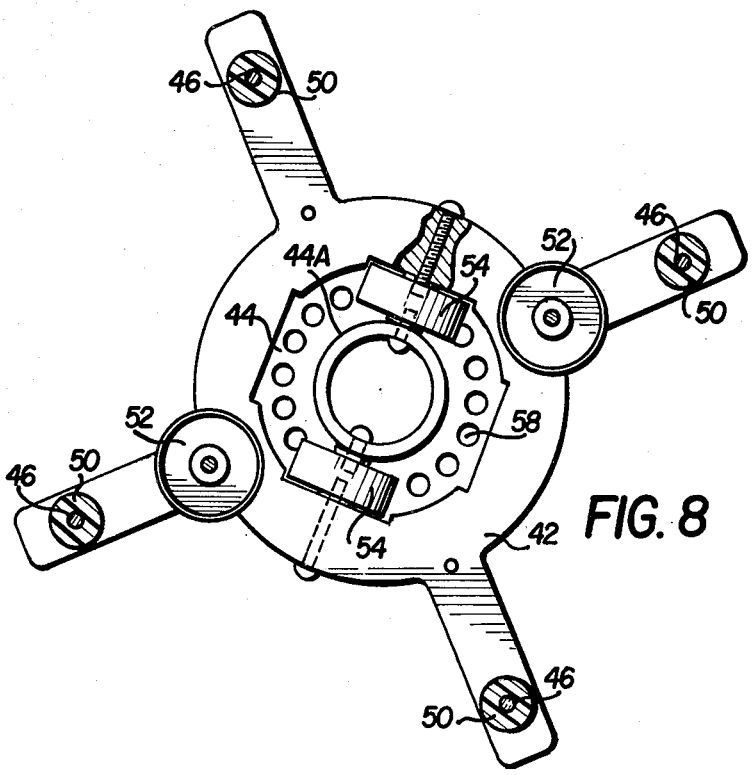
FIG. 8 is a cut-away view taken along the line 8—8 in FIG. 2 showing the feed contactor and balancing capacitors.

Referring once again to FIG. 4, a tiered construction is provided in the lower portion of tube socket assembly wherein upper filament contactor 40, feed contactor 42, and lower filament contactor 44 are rigidly positioned by rods 46 (one of which is shown in FIG. 4), flanged insulators 48, and spacing elements 50. Each of the rods 46 have threaded ends; one of which is threaded into a correspondingly threaded hole in the grid/ground contactor 20 and the other end is in threaded engagement with a nut or suitable fastening means. The flanged insulators 48 and spacing elements 50 may be fabricated from fluoroplastics, such as TFE and PFA. The rigid construction provided by the dimensional thickness of contactors 40,42,44 in conjunction with spacing elements 50 and rods 46 allow the socket assembly 10 to withstand shocks of up to 18 G's. As shown in FIG. 8, each of contactors 40,42,44 have annular central portions (approximately $4\frac{3}{4}$ inches in diameter in the preferred embodiment) and four radially extending appendages (extending approximately 10 inches from end to end in the preferred embodiment). In addition, lower filament contactor 44 is provided with an inner cylindrical extension 44A which provides a connection between the lower filament contactor 44 and the corresponding first filament contact on the base of the tube (not shown). As best shown in FIG. 3, the upper portion of inner cylindrical extension 44A comprises a plurality of resilient finger-like contacts extending around the entire circumference for providing 360° circumferential electrical contact with the corresponding contact on the tube. Similarly, an outer cylindrical extension 40A formed of a plurality of closely spaced, vertically extending finger-like projections is fastened on the upper filament contactor 40 for connection with the second filament contact on the tube. As shown in FIG. 4, inner and outer cylindrical extensions 40A, 44A may be fastened to the upper and lower filament contactors 40, 44 by suitable fastening means such as screws and then brazed with solder or other suitable high temperature materials. Note that both of the cylindrical extensions 40A, 44A provide a full 360° of contact, thereby eliminating "hot spots". Mounted on upper filament contactor 40 are a plurality of pins or tube stops 45 (one of which is shown in FIG. 2) which abut the tube and limit its downward movement.

Figure 9:
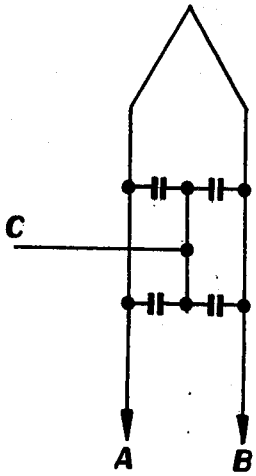
FIG. 9 is a schematic representation of the filament connections in the FIG. 2 embodiment.

The electrical circuitry mbodied by the contactors 40,42 and 44 is best understood by referring to the schematic representation depicted in FIG. 9. Filament contactors 40,44 correspond to leads A,B which provide the base level electrical input into the filament. Feed contactor 42 is represented by lead C in FIG. 9 which carries the modulated signal. Capacitors connect the lead C with the leads A,B to provide a balanced input by creating equal paths of travel for the modulated signal. This balancing technique results in emission of a modulated signal from the filament with a minimum amount of distortion at high frequencies.

As to the actual physical structure of the balanced, capacitive, coupled input to the tube filament, the value of the capacitors to be used is determined by the lowest frequencies to be amplified by the tube. By employing lump value capacitors, large values of capacity; e.g. 3300–13,000 picofarads, can be achieved while utilizing minimum space.

The capacitors utilized for such a balancing technique are uniquely integrated into the physical structure of tube socket assembly 10 as shown in FIGS. 2, 3, 4 and 8. Lump capacitors 52, extend between upper contactor 40 and feed contactor 42 and are secured by suitable fastening means such as screws or the like extending through holes in contactors 40,42 which also provide suitable electrical connection. Likewise, capacitors 54 extend radially between the inner cylindrical extension 44A and the inner periphery of feed contactor 42. Suitable fastening means such as screws or the like are utilized for securing lump capacitors 54 to provide a secure electrical connection. The socket assembly 10 is constructed to accommodate four symmetrically positioned capacitors 52, one at each of the junctions of the appendages of the feed contactor 42 (two capacitors 52 being utilized in the preferred embodiment as shown in FIG. 8) and four symmetrically positioned capacitors 54, one at each of the linear portions on the inner periphery of feed contactor 42 (two capacitors 54 being utilized in the preferred embodiment as shown in FIG. 8). Due to the precision positioning of the capacitors 52,54 the distance travelled by the modulated signal from the feed contactor 42 through capacitors 52, upper filament contactor 40, outer cylindrical extension 40A, and eventually to the tube filament is substantially equal to the distance travelled by the modulated signal from the feed contactor 42 through capacitors 54, cylindrical extension 44A and eventually to the tube filament. Consequently, at high frequencies a balancing effect is achieved whereby distortion of the modulated signal is avoided.

Referring now to FIG. 3, the cover 12 substantially surrounds the circumference of the tube base (not shown in FIG. 3) so as to substantially impede RF from being transmitted to the elements located below cover 12. However, slots or openings 56 are provided through the tube socket assembly 10 to cool the tube anode. Openings 56 are so dimensioned such that the only RF which could enter the openings is generated only above the cutoff frequency of the tube, thus precluding a potential source of RF feedback. Corresponding openings are provided in the bypass capacitors 26, 28, 30, 32, the contactors 14, 18, 20 and grid spacer 16. Furthermore, the annular portions of contactors 40,42,44 do not extend to the inner periphery of openings 56 so that through openings 56 allow cooling air to circulate from the lowermost portion of socket assembly 10 through cover 12 to the anode of the tube. Additionally, ventilation holes 58 are also provided in contactor 44 as seen in FIG. 8.

The size of the openings 56 determines the air pressure required for adequate air flow. Openings 56 of the preferred embodiment are approximately 12.75 square inches. A general equation used to determine the forced air required in cubic feet per minute (CFM) to determine the air temperature rise in degrees Fahrenheit with a given air flow in CFM is:

$$CFM = \frac{3160 \times Kw}{\Delta t(F.)}$$

where:

3160—a constant

KW—Maximum anode dissipation in kilowatts

Δt(F)—The air temperature rise above ambient temperature in degrees fahrenheit.

For example, in a given application it is desirable to keep the anode exhaust temperature below 212° F. with full anode dissipation of 10,000 watts. The ambient temperature in the tube housing is 78° F. so that maximum desirable rise is 134° F. (78°+134°=212° F.). Using the airflow equation:

$$CFM = \frac{3160 \times 10}{134} = 235.8$$

Thus, the input volume of 78° F. air in CFM must be equal to or greater than 235.8 CFM to maintain the air outlet temperature below 212° F.

However, when operating at high frequencies the dimensions of openings 56 must be limited to prevent RF from being fed back from the output to the input. The following equation can be utilized to determine whether the distance A, as represented in FIG. 3, is beyond the critical cutoff wavelength using the following equation:

$$\lambda_c = \frac{\lambda_1/2}{\sqrt{1 - \left(\frac{\lambda_1/2}{2A}\right)^2}}$$

$f_1$=highest operating frequency in megahertz

A=circumferential dimension of the opening in feet $\lambda_1/2$=one half wavelength corresponding to the frequency $f_1$ $\lambda_1 2$=492 ft./$f_1$ If the critical cutoff wavelength, λc, is imaginary, then RF will not penetrate the opening. However, if λc is a real number, the RF will penetrate. Using the values of A=0.42 feet and $f_1$=100 MHz, the highest operating frequency, an imaginary number was found for λc. Consequently, openings 56 (measuring 0.42 feet in the circumferential direction in the preferred embodiment) will not be penetrated by RF at frequencies of 1000 MHz and below.

Figure 6:
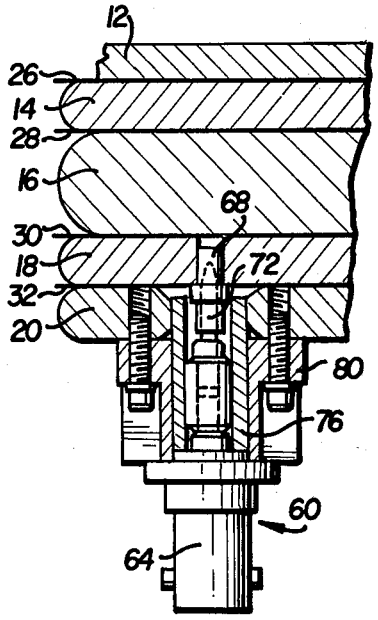
FIG. 6 is a partial cross sectional view taken along line 6—6 in FIG. 3 showing the electrical connection to the control grid contactor.
Figure 7:
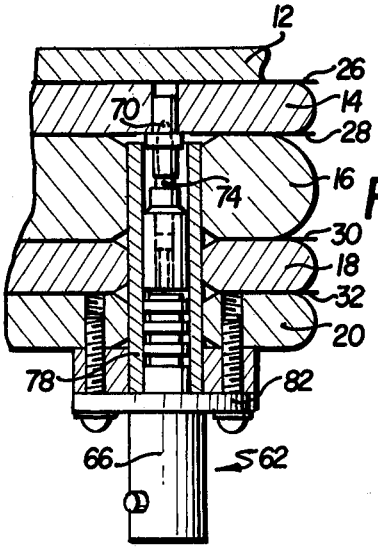
FIG. 7 is a partial cross sectional view taken along line 7—7 in FIG. 3 showing the electrical connection to the screen grid contactor.

Electrical connector subassemblies 60,62 for connecting the external circuitry to grid contactor 18 and screen contactor 14, respectively, are shown in FIGS. 6 and 7. At opposite ends of each of the subassemblies 60,62 are coaxial connectors 64,66 for connection to the external circuitry, and contacts 68,70 which are resiliently biased for continuous connection with the contactors 18, 15, respectively, by bananna jacks, 72,74 (as these resilient extensions are referred to in the art). Insulator sleeves 76,78 surround the internal conductors of the subassemblies 60,62. Suitable fasteners, such as screws the like, engage collar elements 80,82 to secure the subassemblies 60,62 to grid ground contactor 20 to provide a secure, rigid connection. Due to the nature of the fastener construction as well as the resiliency of the contacts, tube socket assembly 10 is capable of withstanding shocks occasioned in such uses as jet aircraft approaching 18 G's.

As stated in the foregoing, the tube socket assembly 10 may be converted from the grounded grid configuration (shown in FIGS. 1–9) to a grounded cathode operation. To accomplish this, the grid spacer 16 and the grid/ground contactor 20 are removed and replaced by insulated spacers. An insulated annular spacer is utilized to replace grid spacer 16 and the insulated spacers 50 are extended to the control grid contactor 18 to compensate for the removal of the grid/ground contactor 20. All bypass capacitors are removed except for bypass capacitor 26 located between the plate 12 and the screen grid contactor 14. In addition, the electrical connector assemblies 60,62 are mounted directly to the grid contactor 18 and screen contactor 14, respectively. Furthermore, since the modulated signal is introduced at the grid rather than the filament, the feed contactor 42 and balancing capacitors 52,54 can be removed.

Obviously, other embodiments and modifications of the present invention will readily come to those of ordinary skill in the art having the benefit of the teachings presented in the foregoing description and drawings. It is, therefore, to be understood that this invention is not to be limited thereto and that said modifications and embodiments are intended to be included within the scope of the appended claims.

What is claimed is:

1. A socket assembly for removably supporting a tube and providing electrical connection therewith comprising:

a first contact means for connection to a first filament connector on a tube;

a second contact means for connection to a second filament connector on a tube, said first and second contact means being adapted to be electrically connected with a tube filament so as to cause electric currents to flow therethrough;

a third contact means for receiving a signal;

a plurality of capacitors positioned between said third contact means and said first and second contact means, respectively, said capacitors being so positioned that a signal travelling from said third contact means simultaneously to said first and second contact means will travel substantially an equal distance to the filament within a tube from which the signal is transmitted;

whereby a signal travels from said third contact means to said filament substantially simultaneously through said first and second contact means through respective capacitors such that distortion is minimized.

2. The tube assembly of claim 1 wherein said plurality of capacitors comprise a plurality of lump capacitors.

3. The tube assembly of claim 1 wherein at least one of said capacitors is rigidly positioned between at least two of said contact means.

4. The tube assembly of claim 3 wherein said first contact means comprises a cylindrical portion rigidly connected to an annular portion, said cylindrical portion being positioned so as to engage a tube, at least one of said capacitors being positioned between said third contact means and said cylindrical portion.

5. A socket assembly for removably supporting a tube and providing electrical connection to external circuitry, said socket assembly having a central axis and comprising:

a cover adapted to be mounted to a housing having a first circular inner opening for allowing entry of a tube base portion;

a plurality of first contactors positioned underneath said cover, each of said first contactors having a second circular inner opening substantially symmetrically located relative to said central axis which is adapted to receive a base portion of a tube, at least one of said plurality of first contactors having contact means for making electrical contact with a tube contact for connection with an element of a tube and at least one of said first contactors being grounded;

at least one connector means or connecting said at least one contactor having contact means with external circuitry;

at least one thin film bypass capacitor positioned between at least one contactor having contact means and at least one of said grounded first contactors so as to form a capacitive path of low impedance to ground;

a plurality of second contactors spatially arranged beneath said first contactors and substantially symmetrically arranged relative to said central axis;

insulated support means for rigidly positioning said second contactors so as to be spaced from said first contactors and from each other; said plurality of second contactors including first and second terminal contactors for electrical connection to the opposite terminals of a tube filament and a feed contactor for feeding a signal into through said terminal contactors into the tube filament;

first and second lump capacitor means positioned between said second contactors, said first terminal contactor having a cylindrical extension symmetrically positioned about said central axis and arranged to contact one terminal of the tube filament, said feed contactor having at least one external contact portion for connection with external circuitry and an opening defined by an inner periphery, said first lump capacitor means being electrically connected with said secured between said inner periphery and said cylindrical extension and said second lump capacitor means being electrically connected with and secured between said feed contactor and said second terminal contactor;

whereby the electrical path of travel from said at least one external contact portion through said first lump capacitor means through said first terminal contactor to the tube filament is substantially the same distance as the electrical path of travel from said at least one external contact portion through said second lump capacitor means through said second terminal contactor to said tube filament, such that a modulated signal may be fed into said feed contactor at said external contact portion to the tube filament without experiencing distortion of the modulated signal at high frequencies.

6. The socket assembly of claim 5 wherein each of said cover and said first contactors have coinciding opening means for allowing the passage of cooling air to flow from underneath said socket assembly through said opening means to cool an anode of a tube, said opening means being configured to prevent RF from entering within the operating frequencies of a tube.

* * * * *